US006877816B1

(12) United States Patent
Farmont

(10) Patent No.: US 6,877,816 B1
(45) Date of Patent: Apr. 12, 2005

(54) ADJUSTING DEVICE FOR BEDS, MATTRESSES, SEATS AND THE LIKE ADJUSTABLE SLATTED BED-FRAMES AND ADJUSTABLES SEAT OR COUCH CUSHIONS

(75) Inventor: Rolf Farmont, Düsseldorf (DE)

(73) Assignee: Westmont Technik GmbH & Co. KG, Dusseldorf (DE)

( * ) Notice: Subject to any disclaimer, the term of this patent is extended or adjusted under 35 U.S.C. 154(b) by 0 days.

(21) Appl. No.: 10/089,129

(22) PCT Filed: Oct. 7, 2000

(86) PCT No.: PCT/EP00/09846

§ 371 (c)(1),
(2), (4) Date: Jun. 24, 2002

(87) PCT Pub. No.: WO01/26509

PCT Pub. Date: Apr. 19, 2001

(30) Foreign Application Priority Data

Oct. 8, 1999 (DE) ..... 299 17 813 U

(51) Int. Cl.[7] ..... A47C 7/02

(52) U.S. Cl. ..... 297/452.63; 297/284.1; 297/354.13; 297/380

(58) Field of Search ..... 297/452.63, 284.1, 297/284.2, 284.3, 380, 354.13, 284.4, 330, 383

(56) References Cited

U.S. PATENT DOCUMENTS 1,886,308 A * 11/1932 Schultes ..... 297/285
3,203,734 A * 8/1965 Seymer ..... 297/452.63
3,492,768 A * 2/1970 Schuster ..... 52/98
3,565,482 A * 2/1971 Blodee ..... 297/284.3
3,877,750 A 4/1975 Scholpp
4,164,356 A * 8/1979 Knight ..... 297/1
5,975,641 A * 11/1999 Delesie ..... 297/452.63

FOREIGN PATENT DOCUMENTS

| | | |
|---|---|---|
| CH | 663 339 A5 | 12/1987 |
| DE | 39 12 422 A1 | 10/1990 |
| DE | 299 03 454 U1 | 7/1999 |
| EP | 0 027 660 A2 | 10/1980 |
| EP | 0 151 816 A1 | 12/1984 |

* cited by examiner

*Primary Examiner*—Anthony D. Barfield
*Assistant Examiner*—Erika Garrett
(74) *Attorney, Agent, or Firm*—Fay, Sharpe, Fagan, Minnich & McKee

(57) ABSTRACT

An adjustment device for beds, mattresses, seats and the like, which adjustment device includes several support elements extending across an adjustment direction and together spanning a support plane and at least one drive device for pivoting of support elements relative to each other for the purpose of a slope or trend change of the support plane. The support elements are provided with at least one mounting element extending across the support plane. Each mounting element is provided with a pivot joint in its first end region. Spacer devices are provided to maintain the spacing of adjacent mounting elements relative to each other in the region of the pivot joint. Spacing adjusters to change the spacing of adjacent mounting elements are provided on the region of the second ends of the mounting element opposite the pivot joints.

50 Claims, 14 Drawing Sheets

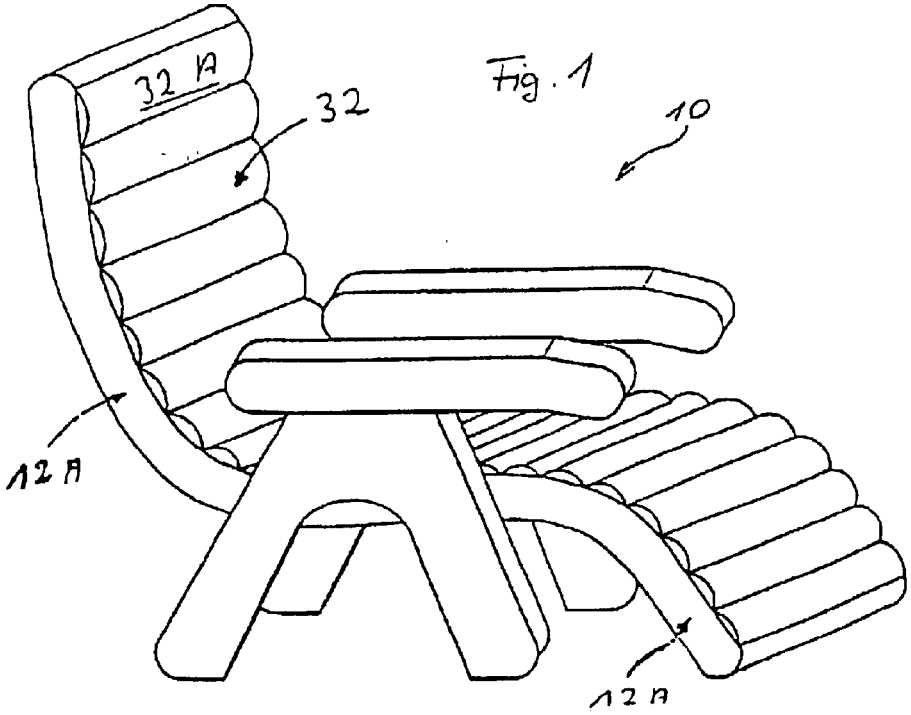
Fig. 1
Fig. 2
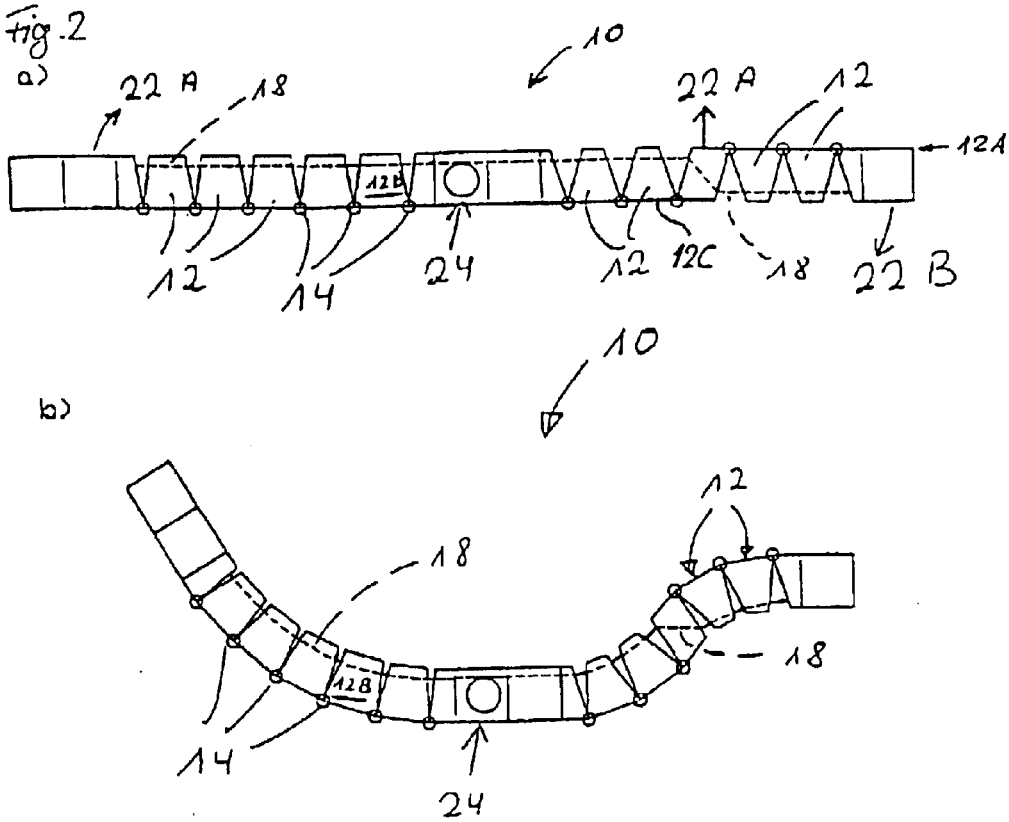

b)

11
20B
14B
13
26A
14A
51; 52; 53
12B'
12B
36B'
12B''
51
36A
52
36
36C
26B
14
38B
53
12B
54
66
38
26A
26
36B'
12B''
36A
26A
36B
26
14
26B
50
36C
38
36B
36B'
36
36A
26A
66
12A
18

12A
13
10
12;38
12C

12B'
51
11
14
12C
36
12B
26B
26
36B
26A
14A
12;38
11
12B
36A
36C
36
18
52
12;38
14
66
36B
26A
26B
26
22A
53
12B''
12B'

28''
28'
50
51
52
53
54
55
56
18
14
36
36B
36C
36A
26A
26B
36B'
66

10
18
18A
18B
19A
19B
21
21A
26
28"
36
36A
36B
36B'
36C
37
40
50
57
58
59
60

ADJUSTING DEVICE FOR BEDS, MATTRESSES, SEATS AND THE LIKE ADJUSTABLE SLATTED BED-FRAMES AND ADJUSTABLES SEAT OR COUCH CUSHIONS

The invention concerns an adjustment device for beds, mattresses, armchairs and the like, which adjustment device includes several support elements extending across an adjustment direction and together spanning a support plane and at least one drive device for pivoting of support elements relative to each other for the purpose of a slope or trend change of the support plane. The Invention also concerns an adjustable slatted frame and an adjustable seat or couch cushion.

BACKGROUND OF THE INVENTION

It is known how to adjust the supports of beds, mattresses, armchairs and the like, known as slatted frames and consisting of two or three support elements, relative to each other by means of a drive motor for the purpose of changing the slope or trend of the support plane. In this case, the support elements, which generally extend over the entire width of the cushion being supported, are relatively long in the longitudinal direction of the cushion. Trend changes are therefore possible only in a relatively crude fashion. Soft, round transitions can scarcely be accomplished, unless these are achieved, in practice, by the cushion; the trends of the support elements and cushion then deviate from each other in the bend regions. In order to achieve a motorized drive for the slope or trend change of the support elements, relatively extensive lever arrangements are required.

With this as point of departure, the problem underlying the invention is to accomplish the least intricate arrangement possible in generic adjustment devices. Moreover, it is desired to avoid greater kinking of the support plane during the slope or trend change of the support plane.

SUMMARY OF THE INVENTION

An adjustment device for beds, mattresses, armchairs and the lie, which adjustment device includes several support elements extending across an adjustment direction and together spanning a support plane and at least one drive device for pivoting of support elements relative to each other for the purpose of a slope or trend change of the support plane. The support elements are provided with at least one mounting element extending across the support plane. Each mounting element is provided with a pivot joint in its first end region. Spacer devices are provided to maintain the spacing of adjacent mounting elements relative to each other in the region of the pivot joint. Spacing adjusters to change the spacing of adjacent mounting elements, are provided on the region of the second ends of the mounting element opposite the pivot joints. Such an adjustment device is proposed to solve the task of accomplishing the least intricate arrangement possible in generic adjustment devices and to avoid greater kinking of the support plane during the slope or trend change of the support plane. The invention is based on the fundamental idea of providing the support elements with mounting elements that project from the support plane, i.e., extend across the support plane, so that the mounting elements are connected in their first end regions to pivot, while maintaining their original spacing relative to each other, and spacing adjusters vary the spacing of adjacent mounting elements in the area of their levers opposing their pivot joint, i.e., can reduce or increase it. The mounting elements thus represent one-sided levers, on one end of which the joints of the support elements are provided, and on the other end of which the adjustment forces act, by means of which the support elements are pivoted relative to each other, around a pivot axis parallel to their direction of longitudinal extension, by reducing or increasing the spacing of the free end of the mounting elements.

In order to increase sitting or lying comfort, to configure the spacing change mechanism simply and to keep the trend change within stipulated limits, pivot lever limitations are preferably provided between adjacent mounting elements and/or support elements. Because of this, the maximum slope or trend change is limited, at least in one direction. Additional spacers can be provided that also limit the maximum change in the opposite direction.

A space- and effort-saving adjustment device preferably has as a spacing change device a windable and unwindable tension belt that is guided around deflection pulleys in the sense of a force reduction, wherein rigid or pivotable levers act as deflection pulley holders in the sense of improved force reduction.

Adjustment devices according to the invention can be used in conjunction with slatted frames, or the slat elements can be integrated into the support elements or vice versa.

An adjustment device according to the invention is particularly suited for motorized, especially electrical adjustment drives, and also permits integration within a mattress or cushion.

The aforementioned components to be used according to the invention, as well as those claimed and/or described in the embodiments, are not subject to special exceptional conditions in terms of size, shape, choice of material and technical design, so that the selection criteria known in the corresponding field of application can find application without restriction within the context of the claims.

Additional details, characteristics, and advantages of the object of the invention are apparent from the claims and the following description of the corresponding drawings, in which preferred variants are shown as examples.

BRIEF DESCRIPTION OF THE DRAWINGS

Reference may now be made to the drawings, which illustrate various embodiments that the invention may take in physical form and in certain parts and arrangements of parts wherein:

FIG. 1 shows a lounge chair with an integrated adjustment device in an oblique view;

FIG. 2*a* shows an adjustment device, in a first embodiment, with a straight trend in a side view (schematic);

FIG. 2*b* shows the same adjustment device in roughly the maximum altered trend, configured in a variety of ways;

DESCRIPTION OF THE PREFERRED EMBODIMENT

From FIG. 1, only the manner in which a lounge chair, configured with an adjustment device according to the invention, is adjustable in its backrest region and its foot support region is apparent from FIG. 1.

It is apparent from FIGS. 2*a* and 2*b* how a so-called slatted frame for beds can be adjustable in a variety of ways with a single drive motor, wherein it is apparent from the almost maximal curvature situation shown in FIG. 2*b* that extended variations in the curvature trend in the pivot plane, i.e., in the longitudinal direction of the slatted frame, for example, can be achieved by means of straight parts, regions bent with different magnitudes and regions,bent in different directions. While the details that permit such a slope change will be explained in conjunction with the following figures, it is pointed out here that in regions of the change points of the slope curve, i.e., where the angle of slope direction changes from right-rotating to left-rotating or vice-versa, a tension/compression belt, serving as a means of spacing change, can vary its position, with respect to the mounting elements still to be explained, from the top down or vice-versa. For this purpose, the tension belt is guided through inclined channels running in the mounting segments in a position close to the end region to a position close to the opposite end region of the mounting elements.

Figure 3:
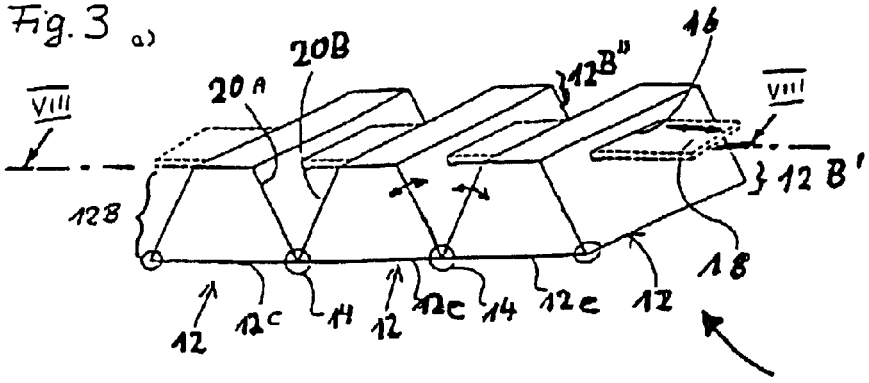
FIG. 3*a* shows the adjustment device according to FIG. 2*a* in a partial oblique view.
FIG. 3*b* shows the adjustment device according to FIG. 2*b* in a partial oblique view.
Figure 3:
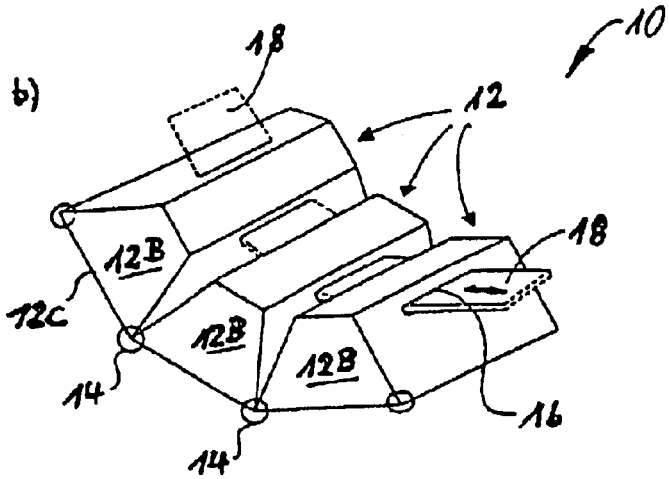

FIGS. 3*a*/*b* show an adjustment device for a slatted frame without slats (also called a bow frame). Such adjustment devices are provided on both sides and run essentially parallel to each other, especially in the end regions of the bow frame on both sides.

The adjustment device denoted overall with 10 has support elements 12, which consist of rigid elements made of wood, metal, plastic or the like, and are provided on both sides with parallel-running pivot joints 14 and thereby connected. The support elements 12 are characterized by the fact that together they span a support plane 12A, simultaneously serving as spacers, since, because of their rigidity, the length of the support plane in the region of pivot joints 14 is neither increased nor reduced. As is further apparent from FIGS. 2*a* to 3*a*/*b*, the support elements 12 can be designed as trapezoidal in cross section. They generally have a not insignificant thickness at right angles to the support plane 12A and therefore form a lever, whose function is still to be explained, that is referred to below as a mounting element 12B. While the spacer device and mounting element are integrated in support element 12 in the drawing, these components can also be separate from each other, so that, in the third embodiment, for example, according to FIG. 5, separate spacer devices 12C are implemented. A flat guide channel 16 is also provided in FIG. 3 in the upper (second) end region 12B", which extends roughly parallel to support plane 12A and accommodates a flat, strip-like tension belt 18, for example, a cord belt, or a tension-compression belt, for example, made of spring band steel.

The trapezoidal surfaces of the support elements 12 serve as lateral stop surfaces 20A, 20B. If the tension belt 18 is fastened to the left mounting element 12B in its upper end region 12B" in FIG. 3*a*, a tension belt 18 acts in the direction of the path shown, so that the two support elements 12 execute a pivoting movement relative to each other until stop surfaces 20A, 20B of adjacent support elements 12 make contact with each other. The maximum pivot travel and therefore the maximum change in slope are therefore achieved. As is apparent from FIG. 2A, the maximum possible pivot angles of adjacent support elements 12 can be different. By a appropriate course of tension belt 18 and arrangement of the pivot joints 14 in the upper and lower end regions of mounting elements 12B, both a convex and a concave curvature of the support plane 12A can be achieved. The position of adjacent stops relative to each other determines the magnitude of the minimal possible radius of curvature of the support plane 12A.

The following embodiments, according to FIGS. 4 to 10, show possible variations during implementation of the concept of the invention.

Figure 4:
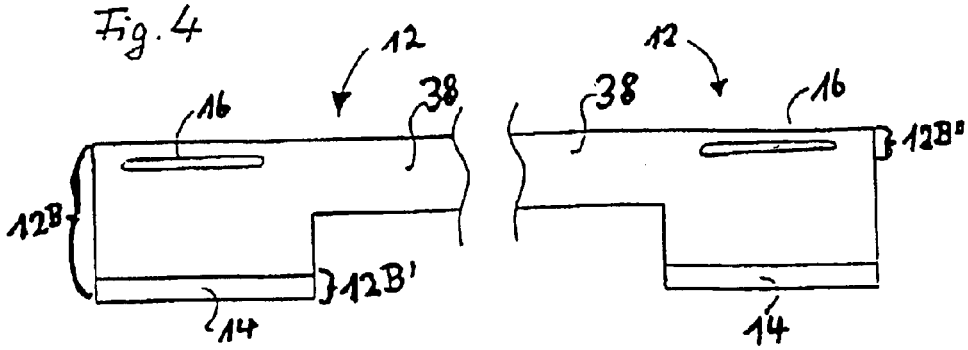
FIG. 4 shows a partial front view of a support element of an adjustment device in a second embodiment.

As is apparent from FIG. 4, a slatted frame for beds, mattresses, armchairs or the like can also be implemented according to the invention in that the bow frame or the slat 38 is integrated with the support elements 12 on both ends as a one-piece component.

Figure 5:
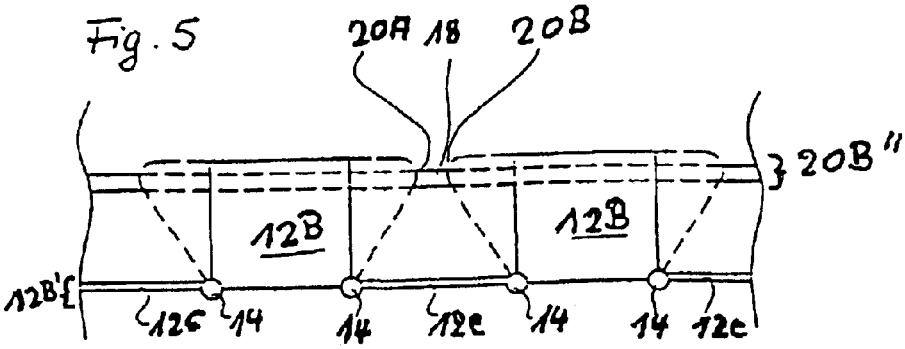
FIG. 5 shows a third embodiment of an adjustment device in a side view.
Figure 6:
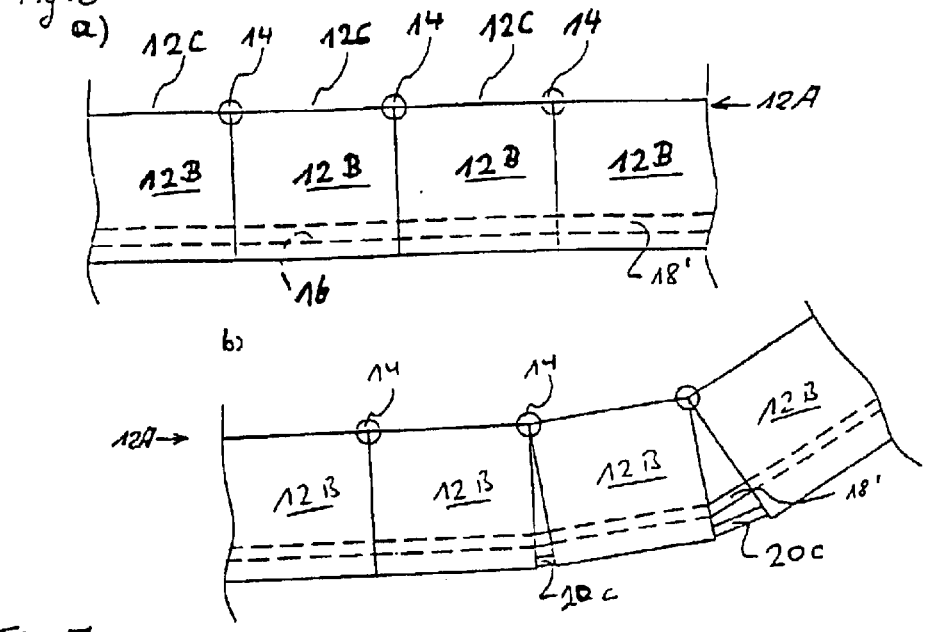
FIG. 6A shows a fourth embodiment of an adjustment device in a side view with the support plane stretched straight.
FIG. 6B shows the same adjustment device with an already partially sloped trend.

In a third embodiment according to FIG. 5, mounting elements 12B are provided between which spacer devices 12C are inserted in hinged fashion in the form of rods or plates. FIG. 5 shows these mounting elements 12B with front and rear pivot joints 14, although in principle, one pivot joint is sufficient, that connects two spacer devices 12C as well as the mounting element 12B lying between them together. For partial bridging of the length of the spacer device 12C, the mounting elements 12B are provided in their upper end regions 12B" with tab-like protrusions that carry stop surfaces 20A and 20B and serve to limit the maximum pivot angle of adjacent support elements relative to each other.

The embodiment according to FIGS. 6*a* and 6*b* shows implementation of the invention with a compression belt, for example, a sheet strip made of spring band steel. To achieve the same range of curvature, the joint side and the changeable spacing side of mounting elements 12B are reversed in comparison with the preceding examples. As is apparent from FIG. 6*b*, other pivot limiters can also be used instead of stop surfaces, such as bendable tension belts 20C. The support plane can be shifted to the concave side of the adjustment device, whereas in other embodiments it is situated on the convex side, or more in the center, of the mounting elements. The choice of the position of support plane 12A has an effect on the compression or expansion that a mattress or cushion experiences during use of adjustment devices according to the invention during a trend change, i.e., a curvature.

Figure 7:
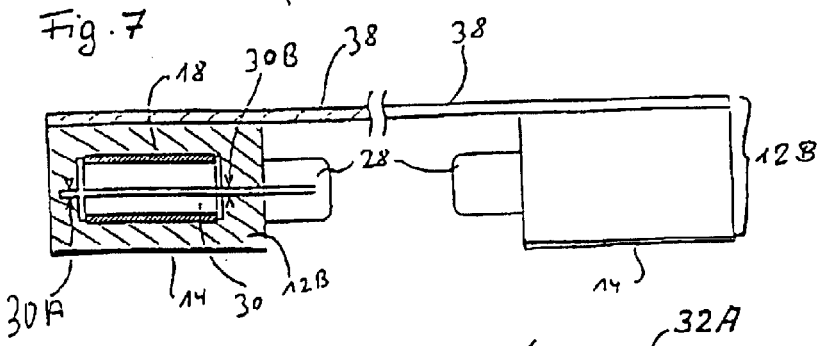
FIG. 7 shows an adjustment device in a fifth embodiment in a front view of a support element with a motorized drive unit, partly in a partial vertical section.

An alternative variant to FIG. 4 is apparent in FIG. 7, in which a slatted frame is implemented whose bow frame or slats 38 again assume the entire frame width, but are produced from a different material or in a different manufacturing process than are the support elements with the mounting elements, It is also apparent in this embodiment how a drive motor 28 and a winding drum 30 can be integrated in the adjustment device. A winding drum 30 in this embodiment is incorporated in a support and mounting element 12, 12B, so that the winding drum bearings 30A, 30B are situated within support element 12. An electric motor with gear, 28, is mounted laterally. While the right half of the figure shows this drive element in a side view, it is shown in the left-half of the figure in a vertical section through the drive axis and, because of this, several winding layers of a tension belt 18 are visible (schematically).

Figure 8:
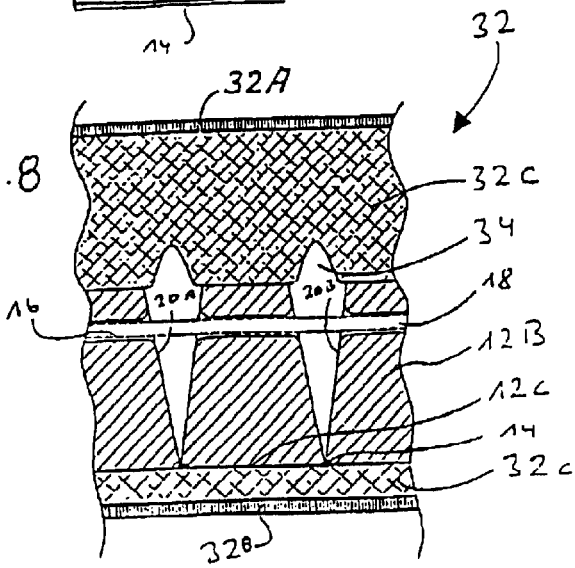
FIG. 8 shows the adjustment device according to FIGS. 2*a* to 3*b* in a vertical section—cut along VIII—VIII of FIG. 3—in a form integrated within a mattress.

The embodiment according to FIG. 8 shows, in vertical section, a complete seat cushion or mattress 32, consisting of upper and lower protective layers 32A, 32B and a core layer 32C, for example, a foam material. The adjustment device according to the embodiment of FIG. 4 is situated in the center. To avoid a material excess in the compression zone of the core layer in the region of the spacer gap between mounting elements 12B, groove-like recesses 34 are provided in core layer 32C. As is apparent, the guide channels 16 are widened at their opening ends in the fashion of a trumpet in order to protect the tension belt.

Figure 9:
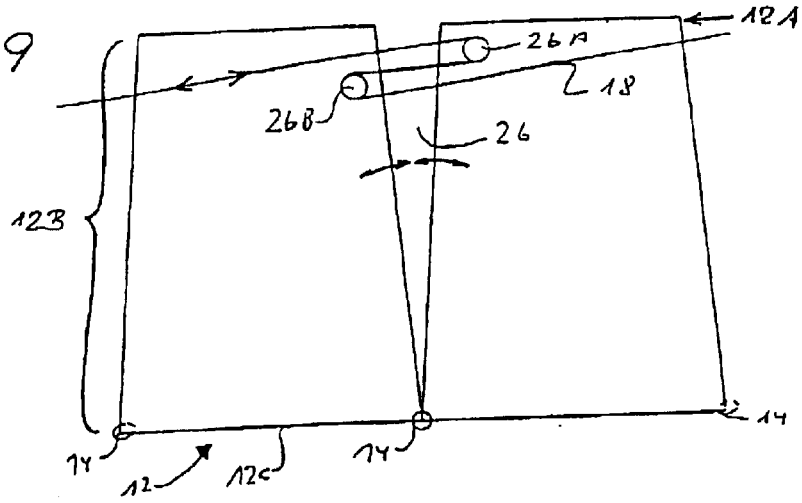
FIG. 9 shows a sixth embodiment of an adjustment device in a side cutout view.

It is apparent from FIG. 9 that a block-and-tackle-like arrangement 26 can be used to improve force reduction, in which deflection pulleys 26A, 26B are provided on adjacent mounting elements 12B, around which the tension belt 18 is accordingly deflected. In this embodiment, a reduction of about 2.5:1 can be reached. In all embodiments with electric motor drive, it is understood that an additional significant force reduction is made possible by using appropriate gear mechanisms, like worm gears.

Figure 10A:
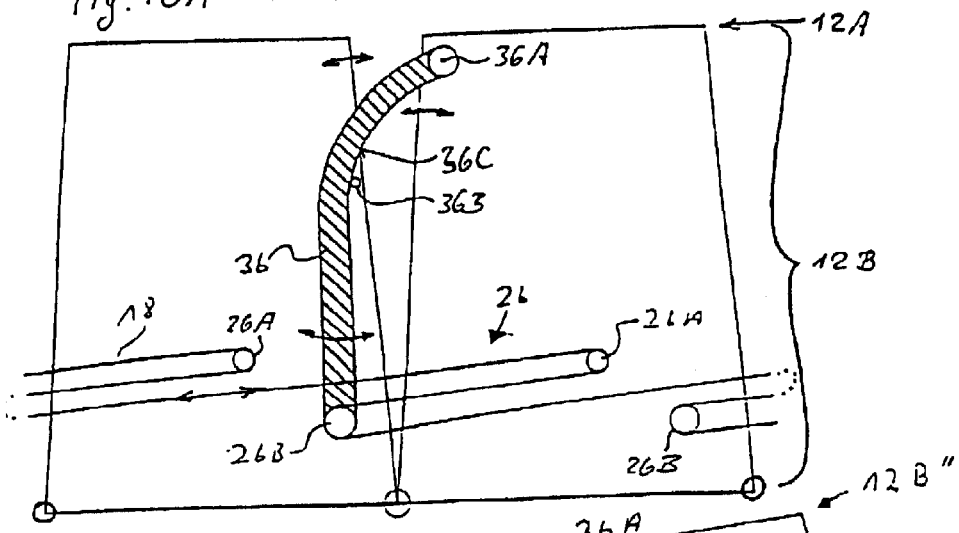
FIG. 10A shows a seventh embodiment of an adjustment device in a side view with the support plane extended straight and FIG. 10B shows the same adjustment device in the maximally adjusted position.
Figure 10B:
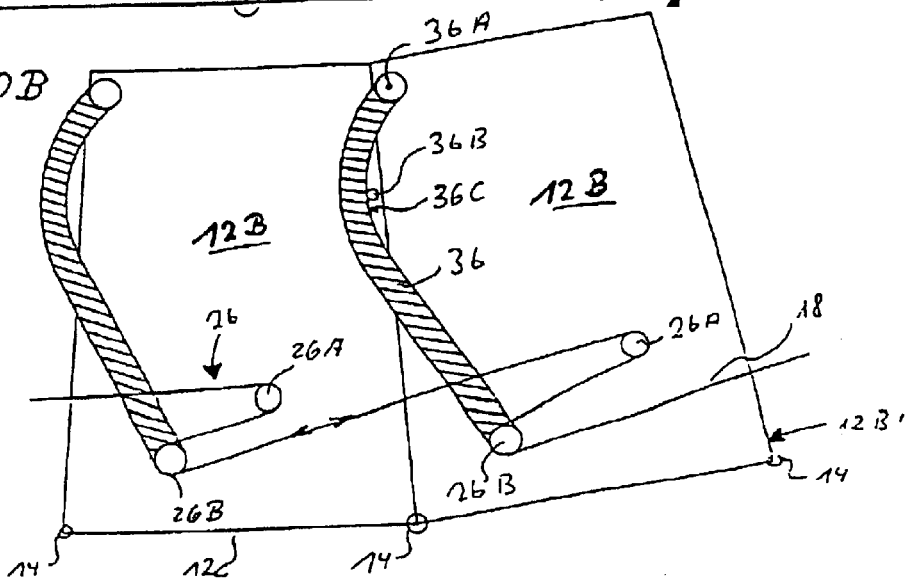

Another embodiment with two force reductions (in addition to perhaps a reduction gear present on the drive) is shown in FIGS. 10A and 10B. Here a block-and-tackle-like arrangement 26 is combined with additional force reduction levers 36, implemented as tension levers. In this case, the deflection pulley 26A is fastened to the corresponding mounting element 12B, while the second deflection pulley 26B is situated on one end of a curved tension lever (force reduction lever 36), that is arranged to be pivotable around a pivot bearing 36A provided on the second end region 12B" of mounting element 12B. A thrust brace 36B is provided on the adjacent mounting element 12B, which is provided here as a tension bearing and is therefore engaged by a contact surface 36C of the force reduction lever 36. By pivoting the force reduction lever 36, the separation gap of mounting element 12B is changed in the region of its two ends 12B". In this embodiment, the free end of the force reduction lever 36 is situated in the vicinity of the pivot joint 14. The adjustment forces must therefore engage the tension belt 18 there. The force reduction ratio is obtained from the ratio of the spacings between the pivot bearing 36A and the thrust brace 36B or the deflection pulley 26B. It is understood that this embodiment is also usable for the application of compression belts or other drive devices. Thus, it is also possible to couple the free ends of the force reduction lever 36 by tension- and compression-proof linkages and therefore actively produce a slope or trend change of the slatted frame or the like in both adjustment directions.

On the other hand, in the other embodiments with a tension or compression belt, coupling of this drive device with the individual mounting elements is not done, so that the active drive occurs in one direction of adjustment, whereas gravitational force is used in the opposite direction of adjustment.

An additional spacing change device not expressly depicted in the drawing uses a so-called lead cable, i.e., a flexible, but compression- and tension-proof means of adjustment with a coiled surface, that can longitudinally move a nut or similar component that is held free of rotation, by rotation around the longitudinal axis. In this embodiment, a correspondingly shaped guide channel on its inside surface could perform the function of a nut. By using right and left threads, the lead cable and adjacent mounting elements can be pulled together or forced away from each other at their free ends 12B in connection with the same direction of rotation.

Figures 11A, 11B:
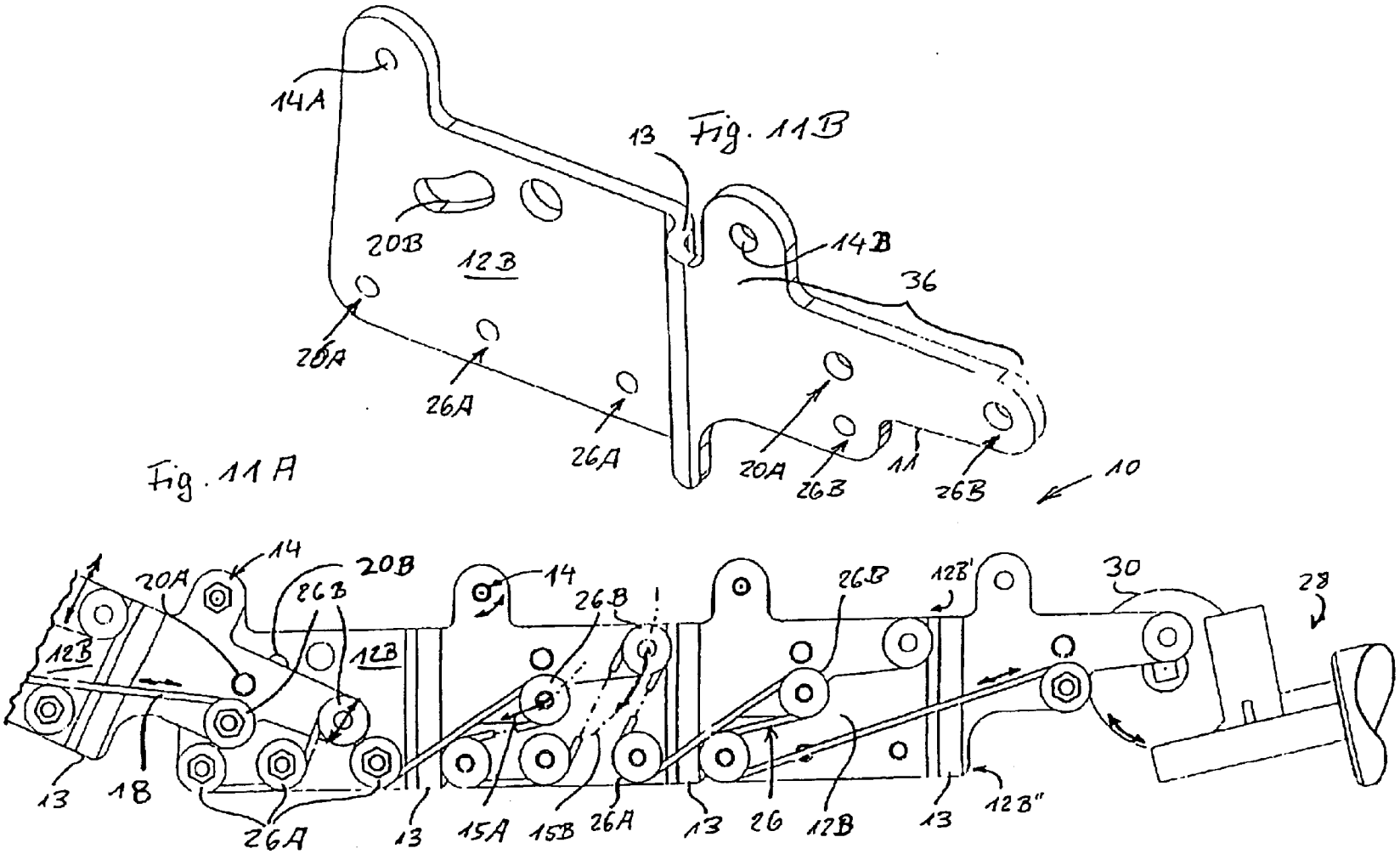
FIG. 11A shows an eighth embodiment of an adjustment device in a broken side view.
FIG. 11B shows the first half of a chain link pair, in an oblique view, for the same adjustment device.
Figure 13:
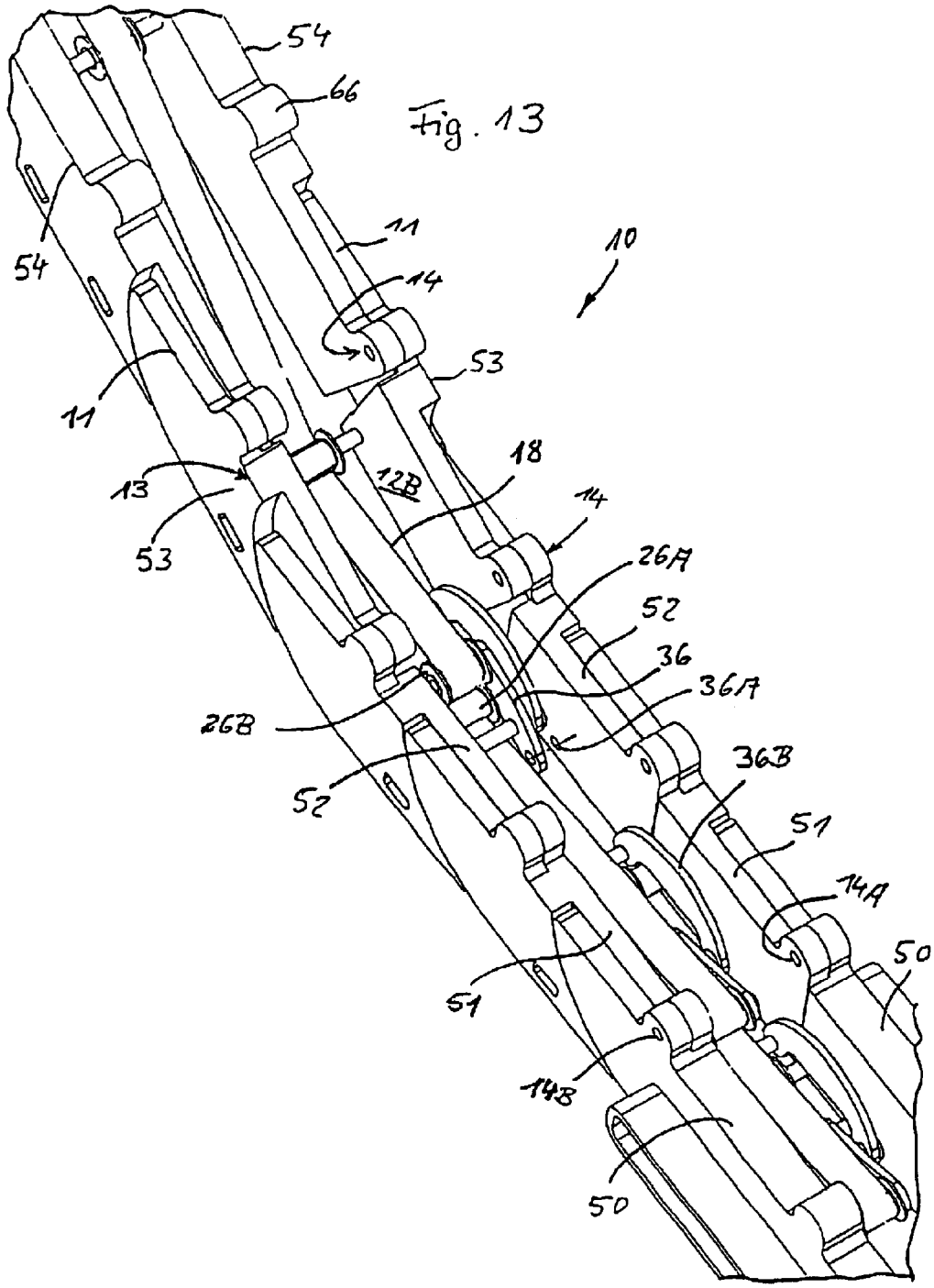
FIG. 13 shows an enlarged perspective view (partial) of the adjustment according to FIGS. 12A to 12J.

Whereas the embodiments according to FIGS. 9 and 10A/B apply a tension belt with force reduction in the fashion of a block-and-tackle, in order to swing the two end regions of the mounting elements opposite the pivot joints toward each other, the embodiment according to FIG. 11A/B shows that a force-reducing tension belt arrangement can also serve to pivot the second mounting element ends away from each other: for this purpose, several mounting elements 12B, punched out from flat metal and exhibiting an offset bend 13 (shown in perspective in FIG. 11B), form a "semi-rigid" chain, depicted in FIG. 11A, which, as shown as an example in another embodiment according to FIG. 13, can be designed by pairing the mounting elements 12B while inserting the spacing change device between them. Each mounting element 12B has holes 14A, 14B in parallel offset planes, which serve as pivot joint 14 in cooperation with adjacent mounting elements. The hole forming the pivot joint part 14B is situated at the broader end of a force reduction lever 36, formed bent on the mounting element 12B, which is formed as a rigid one-sided lever and carries deflection pulleys 26B on the outer end of the lever and in the center region of the lever. These are associated with deflection pulley 26A, which is arranged to rotate on the adjacent mounting element 12B, overlapped by an offset bend, by the force reduction lever 36 in its end region 12B", so that they form a plane with the deflection pulleys 28B. A flexible tension belt 18 is wrapped around the deflection pulleys 26A and 26B, so that a four-part block-and-tackle is produced. The arrangement of pulleys 26B on different lever lengths of the force reduction lever 36 and at different heights of mounting element 12B means that the tension belt 18 becomes active in roughly a tangential direction to the respective pivot circles 15A, 15B of the two deflection pulleys 26B around pivot joint 14. This is shown in FIG. 11A with a dash-dot line and with double arrows.

A horizontal electric motor 28 with gearing serves as the tension belt drive, which drives a tension belt winding drum 30 and is arranged on the right end of the adjustment device 10 in FIG. 11A. Tension exerted by the winding drum means that the tension belt initially pivots the mounting element 12B of the adjustment device situated on the opposite outermost end (on the left in FIG. 11A), because the smallest counterforce prevails there. The entire left mounting element 12B is shown already in the fully pivoted position, in which paired stop surfaces 20A, 20B are active on the mounting elements 12B and the adjacent force reduction lever 36. The mounting elements following the pivoted mounting element 12B, to the right in the drawing, are still unpivoted. They lie against each other in the region of their offset bends 13. Additional pulling on the tension belt means that the mounting elements lying farther to the right are also pivoted successively. Because the mounting element arranged farthest to the right is connected to the one lying next to it on the left via only a two-part block-and-tackle drive, a weaker force reduction is achieved here, especially since only the deflection pulley 26B arranged on the shorter lever arm comes into use. Because of this, it is ensured that the pivot process at this location only occurs at the very end of the upward pivoting movement of the adjustment device, regardless of the length of the adjustment device.

Figures 12A, 12B:
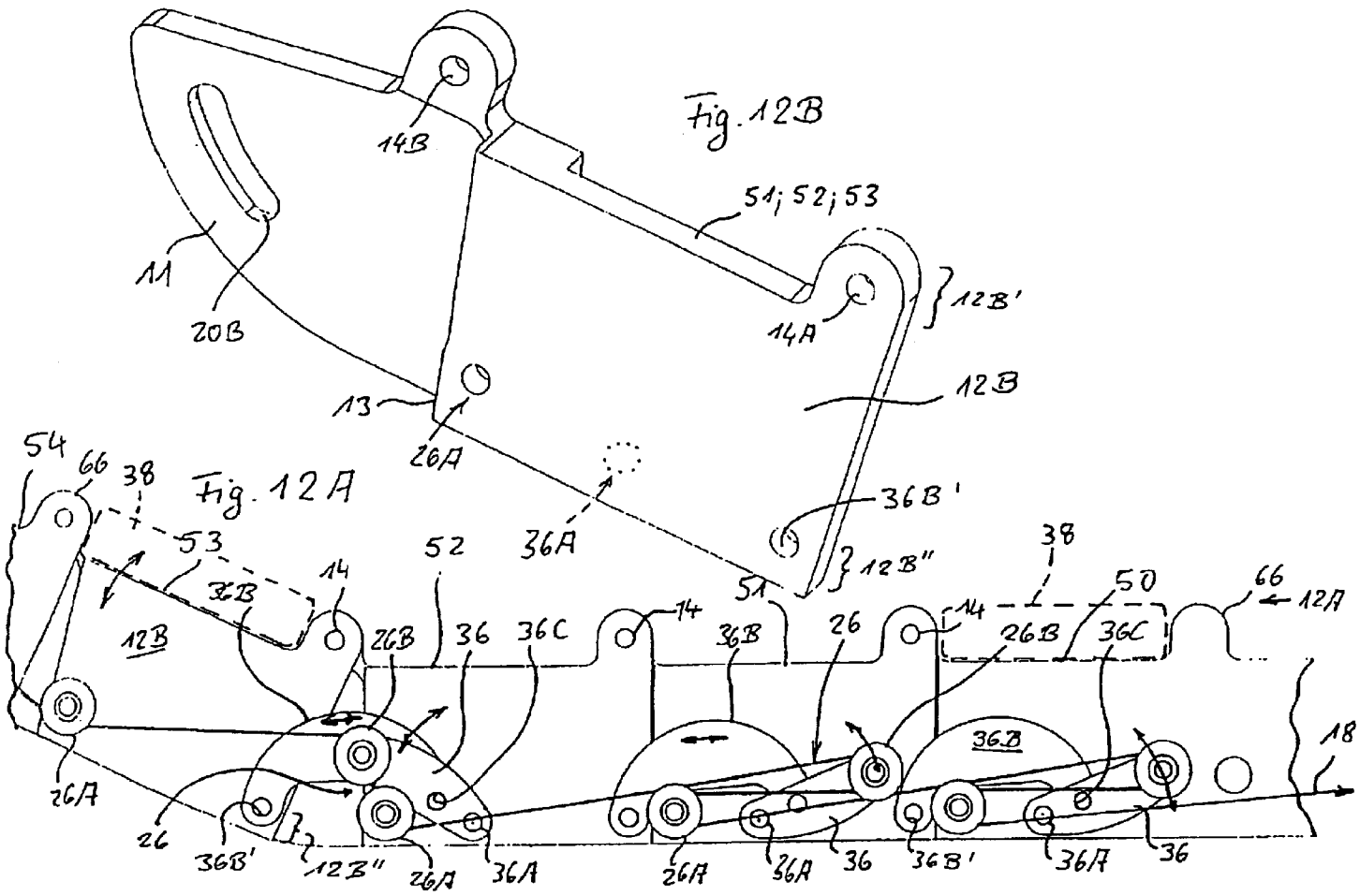
FIG. 12A shows a ninth embodiment of an adjustment device in a broken side view (similar to FIG. 11A)
FIG. 12B shows the first half of a chain link pair for the same adjustment device, in an oblique view.

The embodiment depicted subsequently with reference to FIGS. 12A to 15 is particularly preferred. As is apparent from FIG. 12B, the mounting elements 12B forming a link chain, as in the preceding embodiment, are again bent, and are made of plastic in the present case. As shown in FIG. 12A, the essential differences relative to the preceding embodiment consist of the fact that the block-and-tackle 26 is designed only in two parts, while the force reduction lever 36 (as in the embodiment according to FIG. 10A/10B) is connected to the mounting element 12B in its second end region 12B", pivotable around a pivot bearing 36A at one end. In contrast to FIG. 10A/10B, force reduction of the force reduction lever 36 occurs on the adjacent mounting element in the embodiment according to FIGS. 12A to 15 in the fashion of a compression bearing, so that tension exerted on the tension belt 18 is converted to compression, which pushes the second end regions 12B" apart. This compression bearing has a joint hole as contact surface 36C in the center region of the force reduction lever 36. The thrust brace 36B consists of curved push rod, supported at one end by the contact surface 36C and on the other end by a bearing hole 36B' in the end region 12B" of the adjacent mounting element 12B. Because of the effect of block-and-tackle 26, the pivoting movement of the force reduction lever 36, shown on the left in FIG. 12A with a curved double arrow, causes a pivoting movement of the adjacent mounting element 12B around its pivot joint 14, wherein the thrust brace 36B is active in the push and the pull directions.

As is apparent from FIG. 12B, the guide arm 11, shaped as a circular segment in the example, mounted by offset bend 13 to the mounting element 12B, apart from the guide function merely fulfills the task of linking the adjacent mounting elements, in that the guide arm 11 carries the second pivot joint part 14B for the adjacent pivot element. In the present embodiment, a slot serving as stop surface 20B is also provided in the guide arm 11 for pivot angle limitation. Consequently, unlike the embodiment according to FIG. 11A/B, the guide arm 11 therefore does not function as a force reduction lever.

Otherwise, equivalent components as usual are shown with the same reference numbers as in the preceding embodiments.

Figure 12C:
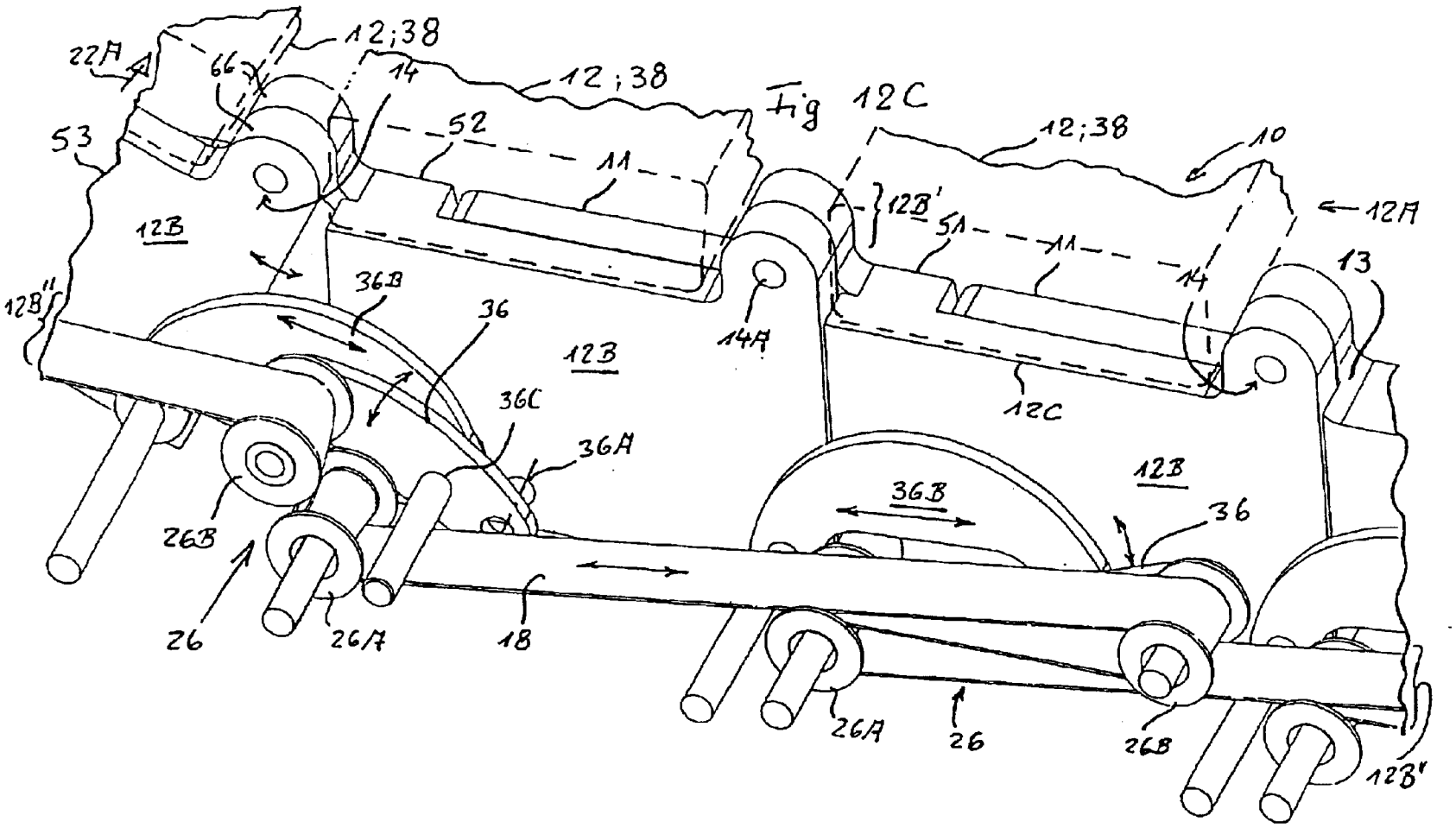
FIG. 12C shows an oblique view (partial) of the adjustment device according to FIG. 12A.

The oblique view according to FIG. 12C of the working situation depicted in FIG. 12A is only supposed to clarify the geometric conditions and linking of the mounting elements.

The adjustment of a slatted frame with head part (FIGS. 12D to 12F) and foot part (FIGS. 12G to 12J) will now be explained for the embodiment according to FIGS. 12A to 15 by means of FIGS. 12D to 12F and 12G to 12J.

Figure 14:
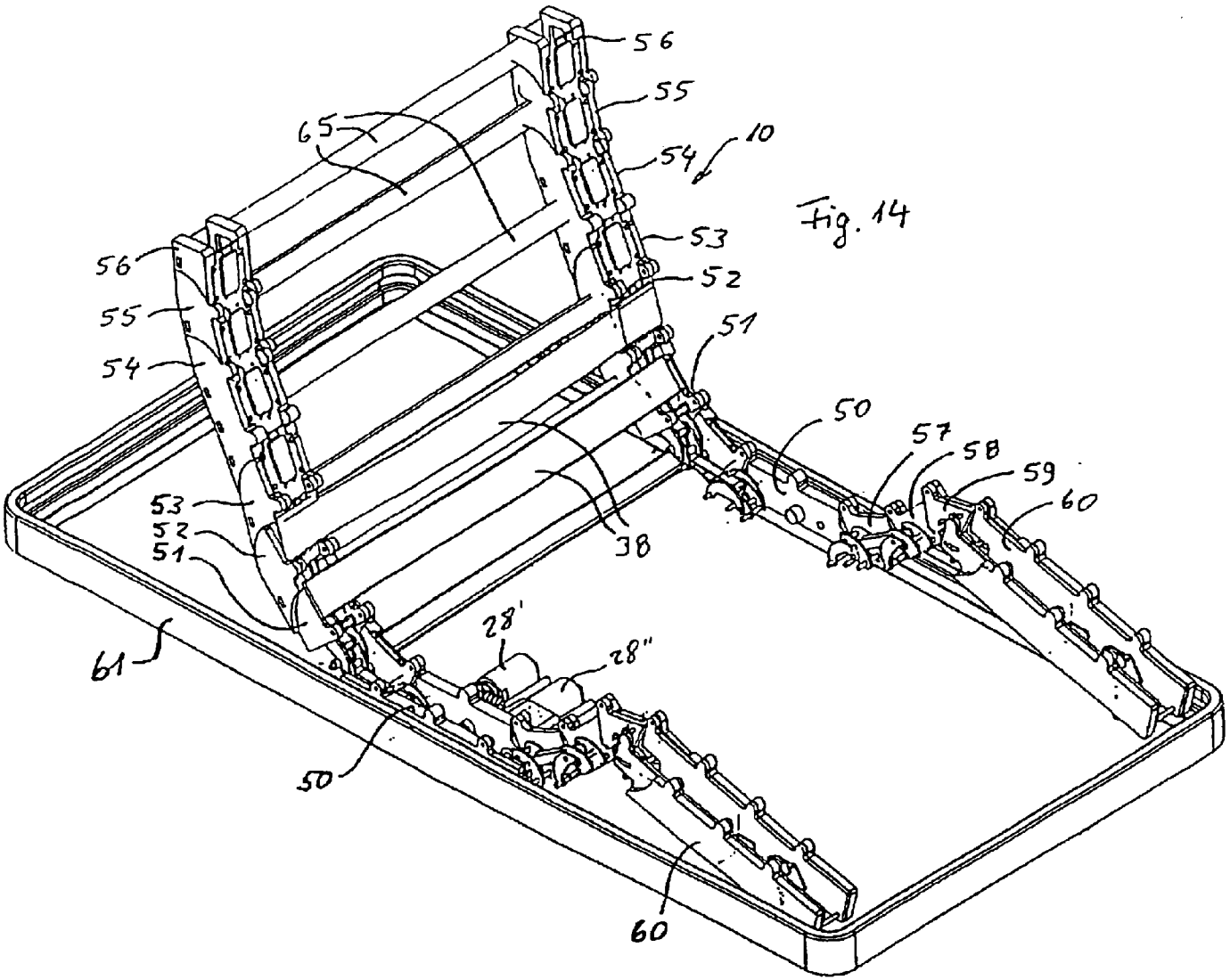
FIG. 14 shows a slatted frame according to the embodiment of FIGS. 12A to 13.

For the adjustment device for an upper head part or head part of a slatted frame of a bed or couch according to FIGS. 14 and 15, seven chain links 50 to 56 are required in the embodiment according to FIGS. 12D to 12F, whose method of operation is described below:

Chain link 50 carries two electric motors with accompanying winding drum, which form the drive 28' for the head part and the drive 28" for the foot part (FIG. 14). Identically designed pivot mechanisms, as move thoroughly explained previously in conjunction with FIG. 12A, act between the chain links 50, 51 and 51, 52, as well as 52, 53. On the other hand, the tension belt 18 acts between chain links 53 and 54, 54 and 55, as well as 55 and 56, according to the embodiment depicted in FIG. 2, i.e., without force reduction. This is possible without problems because of the comparatively more limited lever forces acting between these chain links.

Figures 12D, 12E, 12F:
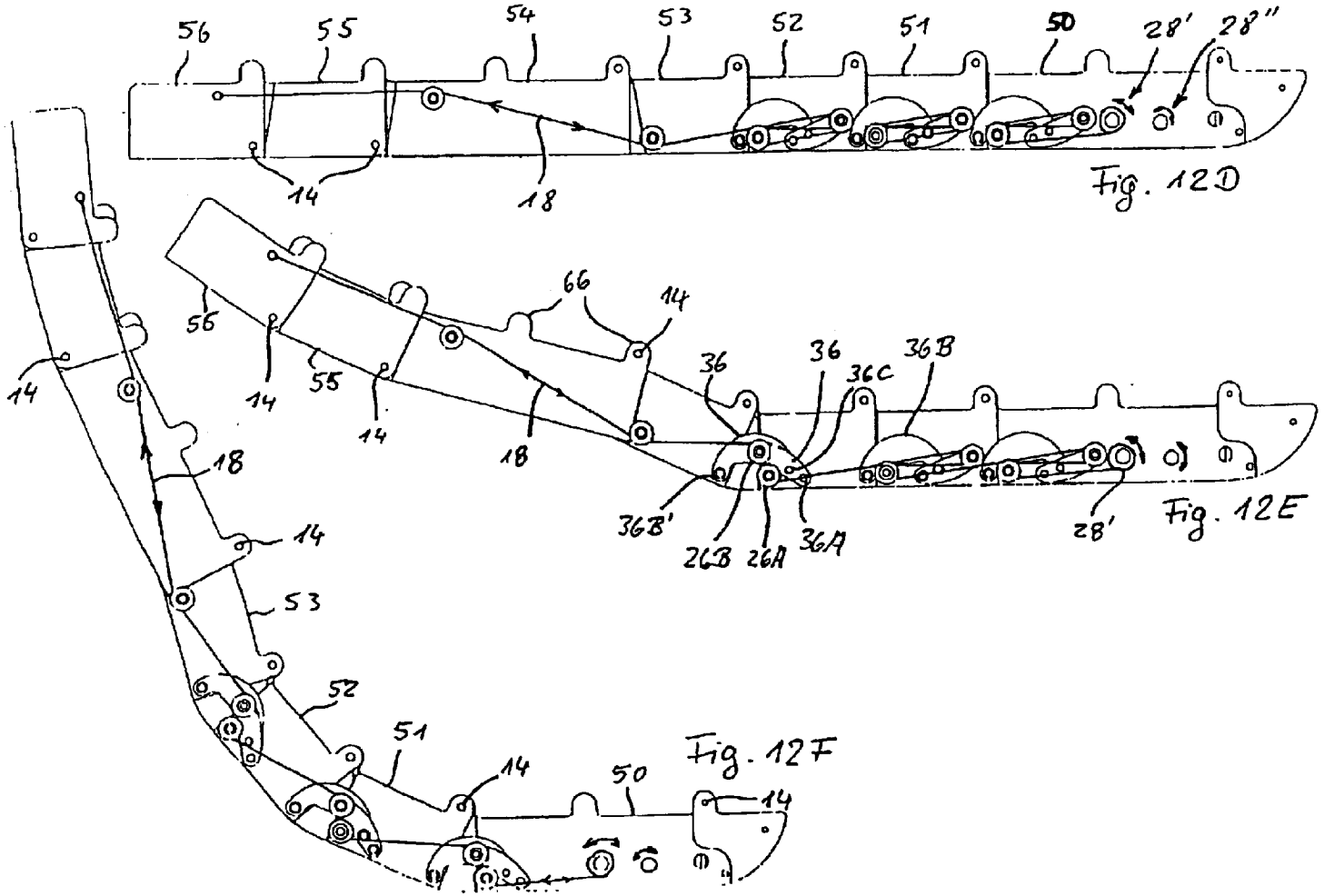
FIGS. 12D to 12F show a movement sequence for the head part of the adjustment device according to the ninth embodiment.

As the work sequence according to FIGS. 12E and 12F shows, during winding up of tension belt 18, a slope adjustment will initially occur at the outer chain links 53 to 56. Because of this, the upper body of a user acquires a comfortable relief of the spinal column. Subsequent erection of the head part in the lumbar region brings the upper body into the semi-upright position, shown in FIG. 12F.

Figures 12G, 12H, 12I, 12J:
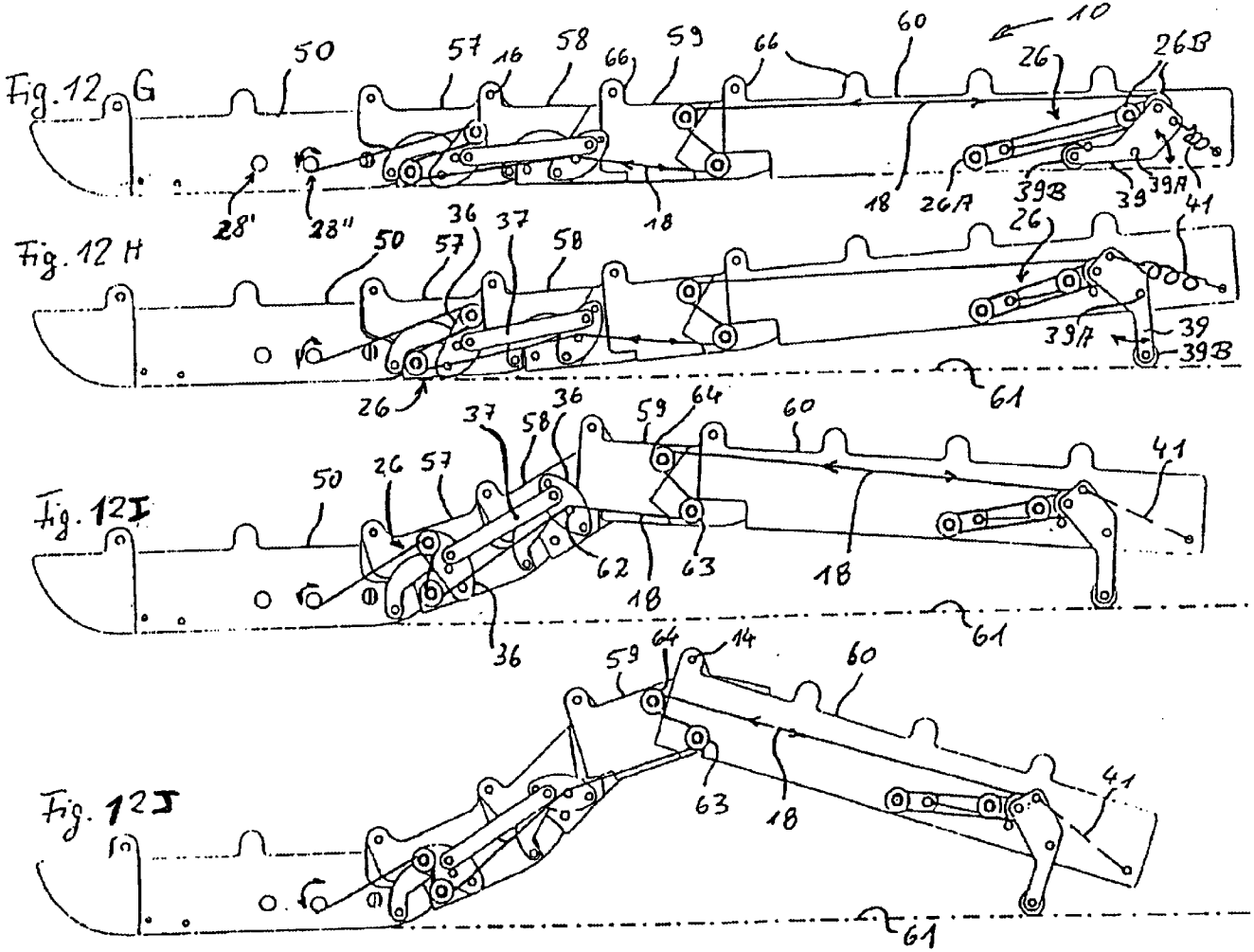
FIGS. 12G to 12J show a movement sequence for the foot part of the adjustment device according to the ninth embodiment.

The foot part, shown in FIGS. 12G to 12J, consists of the chain link 50 and the additional chain links 57 to 60. Chain link 50 consequently represents the common drive base for the head part and foot part. Owing to the different loading conditions and slope requirements, the adjustment device of the foot part differs from that of the head part. On the one hand, an easy, roughly uniformly rising slope of the foot part is desirable, as shown in FIG. 12H, for example, for relieving the veins. For this purpose, the free end of the last chain link 60 of the foot part has a pivotable end region support 39. This is pivotable via a block-and-tackle 26 formed by tension belt 18 and a fixed roller 26A, as well as two movable rollers 26B. The end region support 39 is a two-arm lever pivotable around a pivot bearing 39A on chain link 60, on which the block-and-tackle 26 is active on one end against the restoring force of a spring 41 in the direction of pivoting. On the other end, the end region support 39 carries a glide element 39B, which is supported to glide during pivoting of the end region support 39 from the rest position depicted in FIG. 12G into the support position depicted in FIGS. 12H to 12J on a cushion or bed frame 61, shown in FIGS. 12H to 12J with a dash-dot line.

With further winding up of the tension belt, the adjustment mechanism is initially active between chain links 50 and 57 in the intermediate position depicted in FIG. 12I. This is set up in almost the same manner as the mechanism active between the chain links 50, 51 and 51, 52 and 52, 53 on the head part, as was described in conjunction with FIG. 12A. The adjustment mechanism between the chain links 57 and 58, on the other hand, deviates to the extent that the pivot drive for the force reduction lever 36 is no longer effected via a block-and-tackle, but via a connecting rod 37. This is pivotable on one end on the force reduction lever of the chain link 57, and, on the other end, is connected to the force reduction lever of the chain link 58 and therefore causes synchronization of the angle adjustment of the chain link pairs 50, 57 as well as 57, 58.

On the other hand, a simple pivot adjustment without force reduction is active between the chain links 58 and 59, as was described, in principle, in conjunction with FIG. 2, in which the tension belt 18 is active between a deflection point 62 on chain link 58 and a deflection point 63 on chain link 59. Between the last two chain links 59 and 60, pivoting is only produced toward the end of the adjustment movement. In the working position according to FIG. 12I, these chain links are still unpivoted relative to each other, i.e., they are aligned flush or stretched out to each other. Only in FIG. 12J is a pivot adjustment also achieved in this chain link pair. Here the tension belt 18 acts on a comparatively short lever arm, namely, between the pivot joint 14 of chain link pair 59, 60 and a deflection pulley 64 mounted to rotate on chain link 59.

The separate motor drives 28' and 28" for the head part and foot part have the advantage of smaller structure size, owing to the more limited loading requirements and individual, i.e., independent, adjustability of the head part and foot part.

Figure 15:
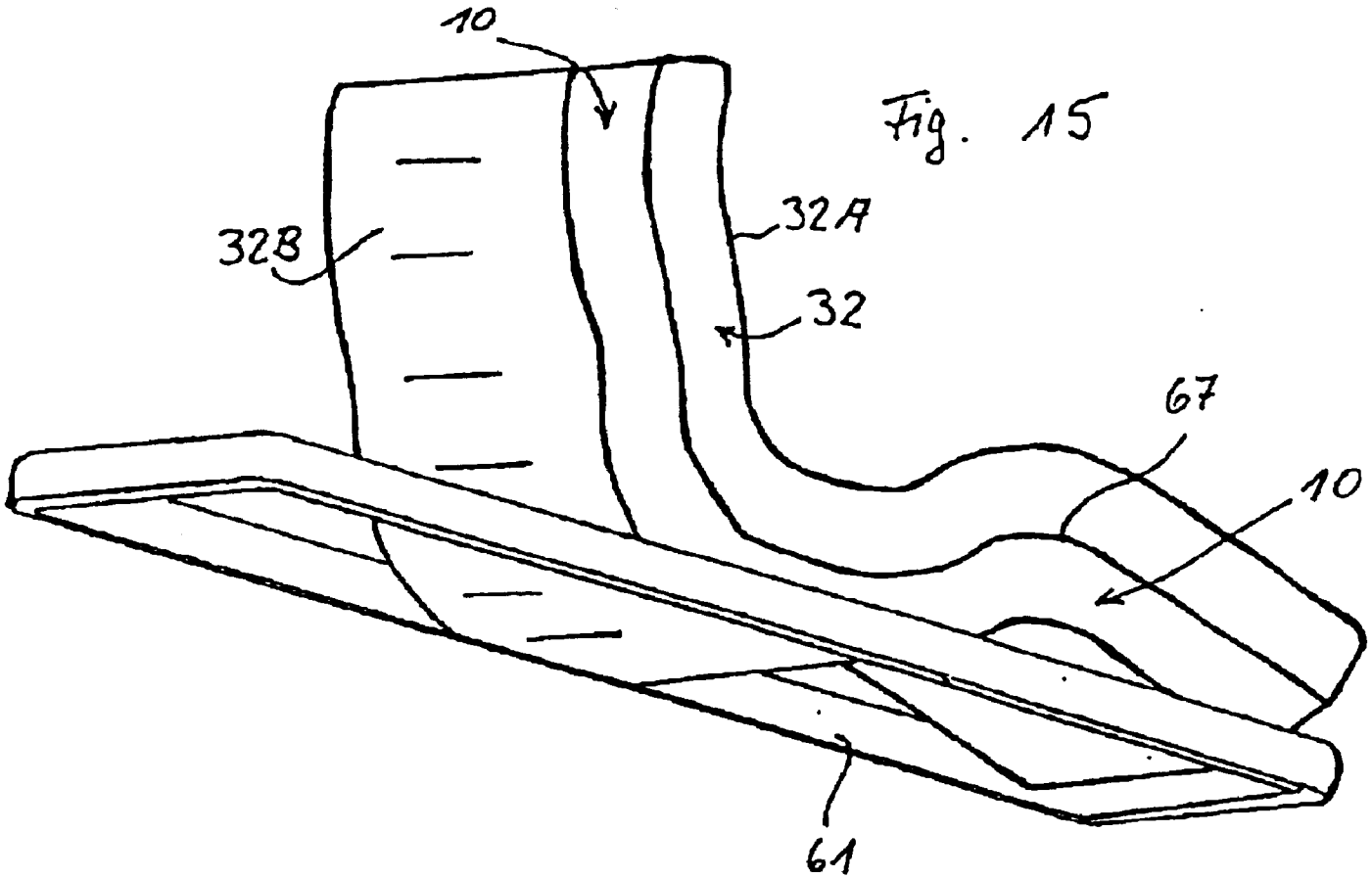
FIG. 15 shows a bed or couch cushion according to the ninth embodiment, according to FIGS. 12A to 14, in an oblique view.

In FIGS. 13 to 15 are shown (i) one of the two adjustment chains (FIG. 13), (ii) the entire slatted frame (FIG. 14), as well as (iii) the upholstered bed or couch mattress (FIG. 15), in the manner apparent from the working position according to FIG. 12F for the head part, and according to FIG. 12J for the foot part. As follows from FIG. 14, cross members 65 can be provided for mechanical stability of the overall adjustment device 10 on the inside between opposite equivalent chain links on the head part and or foot part, for example, integrally connected with them. Such cross members, which are not necessarily provided between each chain link pair, have been left out in the foot part for the sake of clarity. Moreover, bow frames 38 are apparent from FIG. 14, which, in combination, form the support plane 12A of a slatted frame. These bow frames or slats are provided between the adjacent pivot joint parts 14A, 14B that are provided on the hump-like protrusion 66 of mounting elements 12B or chain links 50 to 60 to improve the leverage conditions. Such protrusions 66 are also provided where the spacing between adjacent pivot joints 14 is greater. All protrusions 66 are therefore equidistant.

It is apparent from FIG. 15 that both a cushion 32 and the adjustment device 10 can be fully covered by protective layers 32A and 32B in order to permit a uniform design, wherein a Velcro fastener or zipper 67 can be provided between the upper protective layer 32A and a lower protective layer 32B in the region of the overlapping edge.

Figures 16A, 16B, 16C:
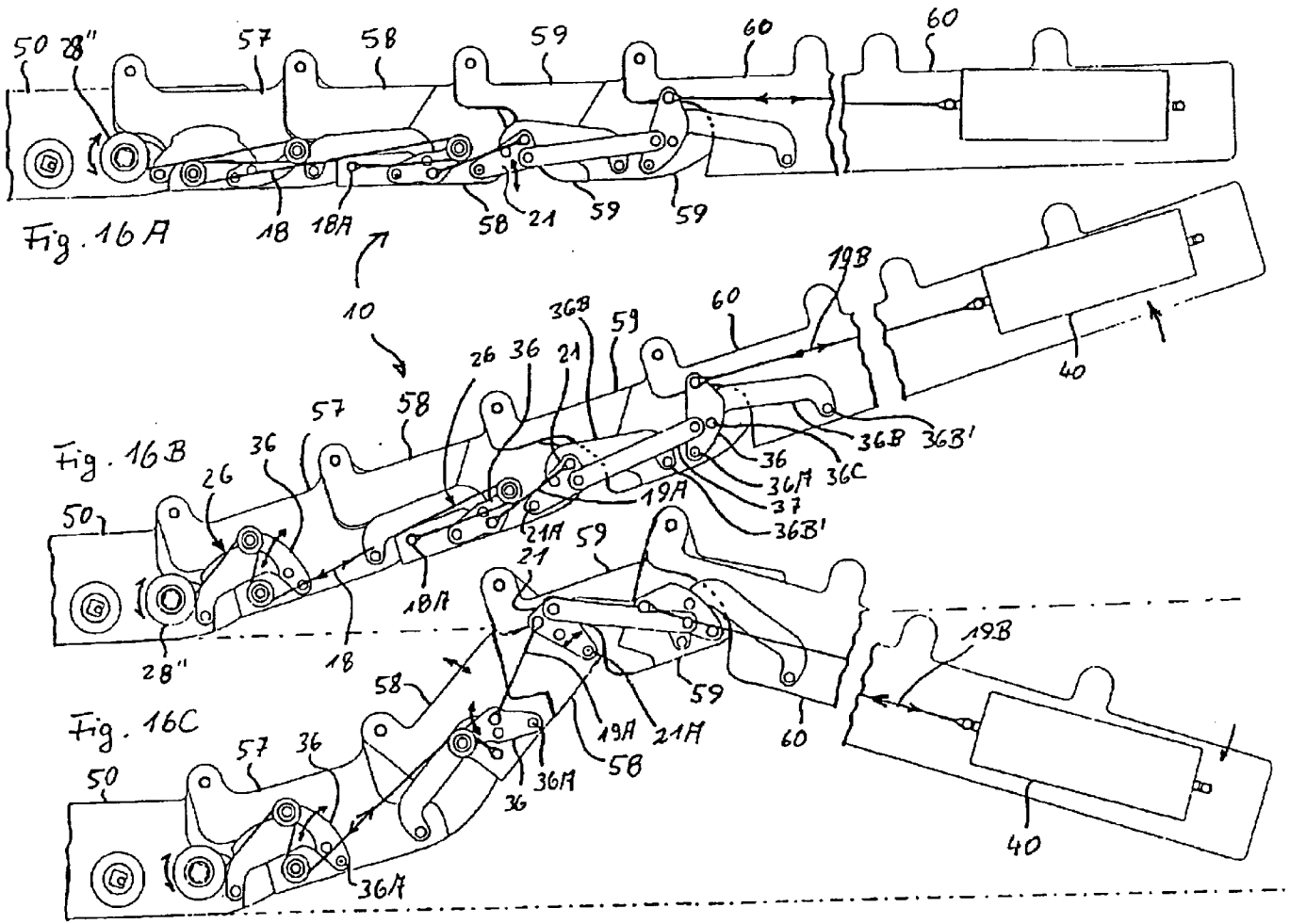
FIGS. 16A to 16C show an adjustment device for a tenth embodiment in a broken side view of the movement sequence of a foot part and FIG. 17 shows an eleventh embodiment of an adjustment device in a broken down side view—in perspective.

The embodiment according to FIG. 16A to 16C shows a variant of an adjustment device for a foot part for the embodiment according to FIGS. 12G to 12J: the pivot adjustment between chain links 50 and 57 corresponds to that from the embodiment according to FIGS. 12G to 12J. In the absence of an end region support, the entire foot part for the vein relieving position, shown in FIG. 16B, must be achieved by this pivot mechanism that consists of a two-part block-and-tackle 26 and force reduction lever 36. The pivoting movement between the chain links 57 and 58, however, deviating from the above, is not synchronized. Instead, it should only become active with further winding up of the tension belt. For this purpose, the reduction ratio of the force reduction lever 36 on chain link 58 is less than the reduction ratio for the chain link pair 50, 57. The tension belt 18 ends already at the fastening point 18A provided on chain link 58. Means of synchronization 19A and 37 are also provided, by means of which first pivoting of the chain link pairs 50, 57 is promoted.

According to FIG. 16B, the chain links 58, 59 and 59, 60 are stretched out toward each other, although the chain link 60 has no end region support. This stretched out position is achieved by a strong tension spring 40 linked to chain link 60, which is coupled via a tension belt 19B to the free end of a force reduction lever 36 fastened to pivot on chain link 59. The tension belt 19B loads the force reduction lever 36 of chain link 59 clockwise. As explained in conjunction with FIG. 12A, a thrust brace 36B is fastened to pivot on one end on the contact surface 36C of the force reduction lever 36 and on the other end in the bearing hole 36B' of chain link 60 and therefore acts as a compression bearing, which keeps the chain links 59 and 60 in the stretched out position in reaction to the tension spring force 40. The force reduction lever 36 of chain link 59 is connected via a synchronization rod 37, as known from FIGS. 12G to 12J, to an auxiliary lever 21 mounted to pivot on the next chain link 58, and the auxiliary lever 21 of chain link 58 is also connected to pivot with an extension lever serving as thrust brace 36B, which acts on the other end in a bearing hole 36B' of chain link 59. Since the auxiliary lever 21 is tightened clockwise by means of the tension belt 19B and connecting rod 37, the thrust brace 36B linked to the auxiliary lever 21 maintains the stretched out position shown in FIG. 16B between the chain links 58 and 59. An additional tension belt 19A, which connects the auxiliary lever 21 of chain link 58 to the force reduction lever 36 of chain lever 58, still has no special effect in this position of the adjustment device depicted in FIG. 16B. If the chain link 60 in this position is pressure-loaded from above by a person or an unduly heavy object, it can divert this pressure downward, owing to tension spring 40, without the adjustment device being loaded on this account between chain links 50 and 57 or 57, and 58. A certain pivoting movement downward then develops only between chain links 58 and 59 and 59 and 60, owing to the raising of auxiliary lever 21. By mean of this raising, the tension belt 19A becomes slack and transfers no forces to the adjustment mechanism under load between the chain links 50 and 57 and 57 and 58 from the tension belt 18. The tensile forces of the tension belts 19A and 19B therefore act in the opposite direction. If the tension belt 18 is wound up farther, as shown in FIG. 16B, the force reduction lever 36 mounted to pivot on chain link 58 is pivoted counterclockwise because of this. If this pivoting movement is continued, this force reduction lever 36 entrains the auxiliary lever 21 by means of the tension belt 19A to move counterclockwise. This assumes that the tensile force exerted by tension belt 18 on tension belt 19A is greater than the oppositely acting tensile force exerted by spring 40. Additional winding up of tension belt 18 now also causes, by forced pivoting of auxiliary lever 21, a pivoting movement downward that is synchronized between chain links 58 and 59, on the one side, and 59 and 60, on the other, via connecting rods 37, so that finally the relaxed position assumed in FIG. 16C, is occupied by the chain links 59 and 60.

Figure 17:
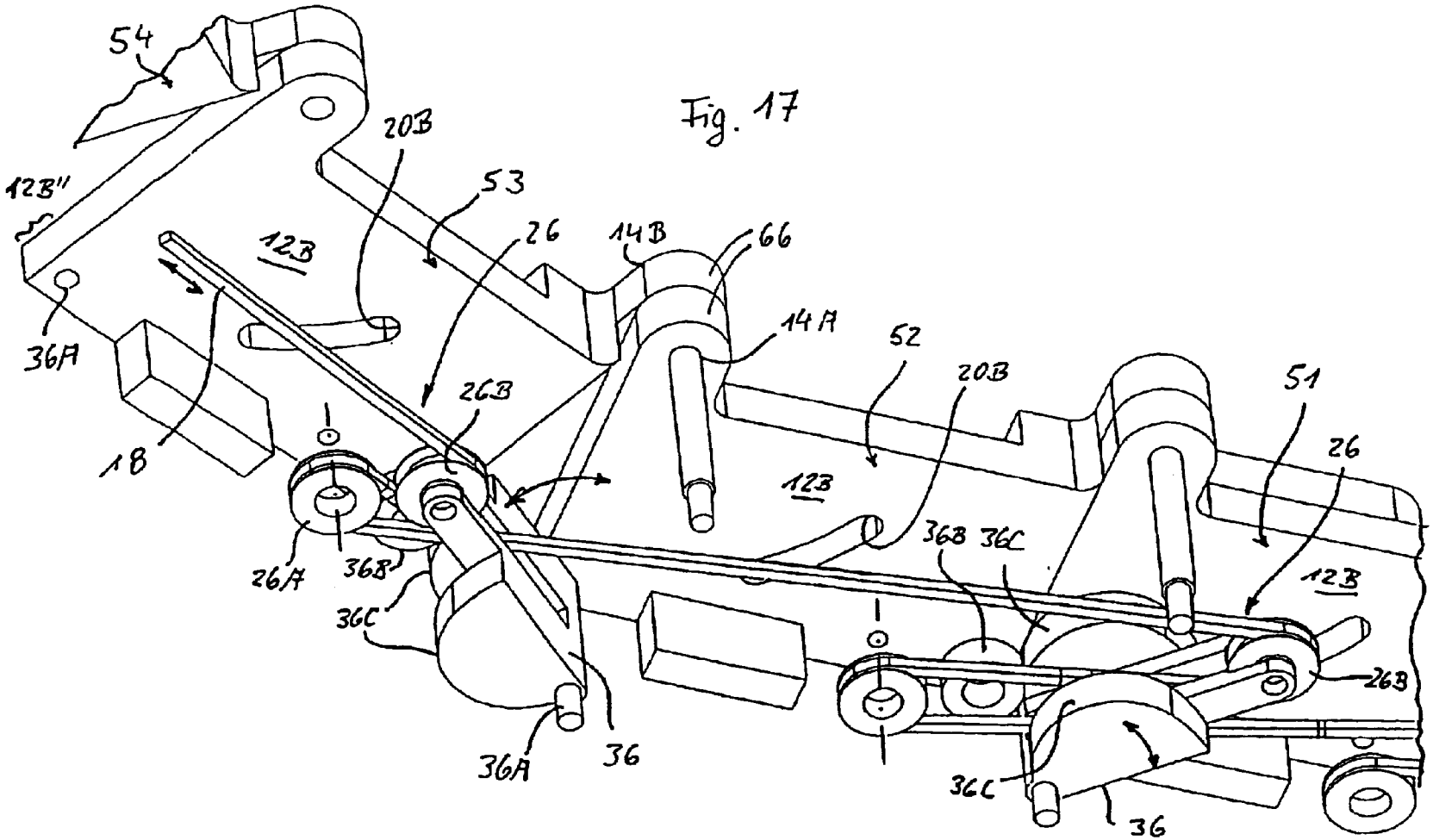

In the additional embodiment according to FIG. 17, chain links 51, 52, 53 and 54 with an offset bend are again provided for a paired arrangement (as in FIG. 13). In this embodiment, equivalent components have the same reference numbers as in the preceding embodiments. The embodiment according to FIG. 17 represents a variant of the embodiment according to FIGS. 12A to 16. In this embodiment, a force reduction lever 36 is connected to pivot by means of a pivot bearing 36A in the second end region 12B" of each mounting element 12B. It carries on its free end the "movable" deflection pulley 26B of a two-part block-and-tackle 26, whose "fixed" pulley 26A is fastened to rotate on the adjacent mounting element 12B in its second end region 12B'. If, a tensioning movement is executed on the right end of the tension belt 18 in the figure, the force reduction levers 36 are pivoted in succession, i.e., beginning on the left in the figure, in the counterclockwise direction into a position such as is shown in FIG. 17 for the left force reduction lever 36. A contact surface 36C with a roughly semicircular shape, provided in pairs on the force reduction lever 36, is supported during this pivoting movement on a roller that serves as thrust brace 36B. This is fastened to rotate on the adjacent mounting element 12B. The compression bearing so produced causes transfer of the pivoting movement of the force reduction lever 36 to the adjacent chain link/mounting element. The curve profile of the contact surface 36C then determines the leverage conditions and consequently the reduction ratio between the pivoting movement of the force reduction lever 36 and the adjacent chain links concerned, as well as the change in this reduction ratio during the pivoting movement of the force reduction lever 36.

It is understood that the components shown in the previous embodiments can also be substituted for each other and combined with each other in a variety of ways.

What is claimed is:

1. An adjustment device for beds, mattresses, seats and the like, comprising a plurality of support elements extending across an adjustment direction and spanning a support plane, and at least one drive device to pivot a plurality of said support elements relative to each other for the purpose of a slope or trend change of the support plane, said support elements being provided with at least one mounting element extending across the support plane, said mounting element being provided with a pivot joint in a first end region of said mounting element, at least one spacer device being provided to maintain the spacing of adjacent mounting elements relative to each other in the region of said pivot joint, and a plurality of spacing adjusters to change the spacing of adjacent mounting elements on the region of a second end of said mounting element that is positioned opposite the pivot joints, said spacing change device including a tension belt, said tension belt is guided upon sensing a force reduction on at least one deflection pulley, said force reduction on said at least one deflection pulley resulting directly or indirectly from said mounting elements.

2. The adjustment device as defined in claim 1, wherein said spacing change device includes a compression belt.

3. The adjustment device as defined in claim 2, wherein said spacing change device is windable.

4. An adjustment device for beds, mattresses, seats and the like, comprising a plurality of support elements extending across an adjustment direction and spanning a support plane, and at least one drive device to pivot a plurality of said support elements relative to each other for the purpose of a slope or trend change of the support plane, said support elements being provided with at least one mounting element extending across the support plane, said mounting element being provided with a pivot joint in a first end region of said mounting element, at least one spacer device being provided to maintain the spacing of adjacent mounting elements relative to each other in the region of said pivot joint, and a plurality of spacing adjusters to change the spacing of adjacent mounting elements on the region of a second end of said mounting element that is positioned opposite the pivot joints, a guide channel in a second end region of said mounting element.

5. The adjustment device as defined in claim 3, including a guide channel in a second end region of said mounting element.

6. An adjustment device for beds, mattresses, seats and the like, comprising a plurality of support elements extending across an adjustment direction and spanning a support plane, and at least one drive device to pivot a plurality of said support elements relative to each other for the purpose of a slope or trend change of the support plane, said support elements being provided with at least one mounting element extending across the support plane, said mounting element being provided with a pivot joint in a first end region of said mounting element, at least one spacer device being provided to maintain the spacing of adjacent mounting elements relative to each other in the region of said pivot joint, and a plurality of spacing adjusters to change the spacing of adjacent mounting elements on the region of a second end of said mounting element that is positioned opposite the pivot joints, said spacing change device includes at least one force reduction lever provided on at least one of said mounting elements.

7. The adjustment device as defined in claim 1, wherein said spacing change device includes at least one force reduction lever provided on at least one of said mounting elements.

8. The adjustment device as defined in claim 5, wherein said spacing change device includes at least one force reduction lever provided on at least one of said mounting elements.

9. The adjustment device as defined in claim 7, wherein said force reduction lever carries at least one of said deflection pulleys for said tension belt.

10. The adjustment device as defined in claim 8, wherein said force reduction lever carries at least one of said deflection pulleys for said tension belt.

11. The adjustment device as defined in claim 9, wherein said force reduction lever is rigidly connected to said mounting element.

12. The adjustment device as defined in claim 10, wherein said force reduction lever is rigidly connected to said mounting element.

13. The adjustment device as defined in claim 11, wherein at least one of said deflection pulleys is arranged on said mounting element in said end region, and that at least one of said deflection pulleys is arranged on said force reduction lever in the region of said adjacent mounting element.

14. The adjustment device as defined in claim 12, wherein at least one of said deflection pulleys is arranged on said mounting element in said end region, and that at least one of said deflection pulleys is arranged on said force reduction lever in the region of said adjacent mounting element.

15. The adjustment device as defined in claim 9, wherein said force reduction lever is fastened to a pivot in said end region that is opposite said pivot joint of a corresponding mounting element.

16. The adjustment device as defined in claim 10, wherein said force reduction lever is fastened to a pivot in said end region that is opposite said pivot joint of a corresponding mounting element.

17. The adjustment device as defined in claim 15, wherein a contact surface for a thrust brace of said adjacent mounting element is provided on said force reduction lever.

18. The adjustment device as defined in claims 16, wherein a contact surface for a thrust brace of said adjacent mounting element is provided on said force reduction lever.

19. The adjustment device as defined in claim 17, wherein said thrust brace is rotatable.

20. The adjustment device as defined in claim 18, wherein said thrust brace is rotatable.

21. The adjustment device as defined in claim 17, wherein said thrust brace is designed as a push rod.

22. The adjustment device as defined in claim 18, wherein said thrust brace is designed as a push rod.

23. The adjustment device as defined in claim 19, wherein said force reduction lever is a tension lever.

24. The adjustment device as defined in claim 20, wherein said force reduction lever is a tension lever.

25. The adjustment device as defined in claim 23, wherein at least two force reduction levers of different mounting elements are drive-connected by at least one connecting rod.

26. The adjustment device as defined in claim 24, wherein at least two force reduction levers of different mounting elements are drive-connected by at least one connecting rod.

27. The adjustment device as defined in claim 6, including an extendable end region support.

28. The adjustment device as defined in claim 26, including an extendable end region support.

29. The adjustment device as defined in claim 25, wherein said drive device includes a winding drum.

30. The adjustment device as defined in claim 28, wherein said drive device includes a winding drum.

31. The adjustment device as defined in claim 6, wherein said spacings of said stop surfaces of adjacent mounting elements vary along said support plane according to a maximum desired slope change between an unadjusted and maximally adjusted inclination in use.

32. The adjustment device as defined in claim 30, wherein said spacings of said stop surfaces of adjacent mounting elements vary along said support plane according to a maximum desired slope change between an unadjusted and maximally adjusted inclination in use.

33. The adjustment device as defined in claim 6, wherein said adjustment device is arranged within a cushion.

34. The adjustment device as defined in claim 32, wherein said adjustment device is arranged within a cushion.

35. The adjustment device as defined in claim 33, wherein said cushion includes recesses in zones adjacent to said second end regions of said mounting elements.

36. The adjustment device as defined in claim 34, wherein said cushion includes recesses in zones adjacent to said second end regions of said mounting elements.

37. An adjustment device for beds, mattresses, seats and the like, comprising a plurality of support elements extending across an adjustment direction and spanning a support plane, and at least one drive device to pivot a plurality of said support elements relative to each other for the purpose of a slope or trend change of the support plane, said support elements being provided with at least one mounting element extending across the support plane, said mounting element being provided with a pivot joint in a first end region of said mounting element, at least one spacer device being provided to maintain the spacing of adjacent mounting elements relative to each other in the region of said pivot joint, and a plurality of spacing adjusters to change the spacing of adjacent mounting elements on the region of a second end of said mounting element that is positioned opposite the pivot joints, said spacing change device including a lead cable rotatable around a longitudinal axis and said mounting element having a lead cable nut.

38. The adjustment device as defined in claim 36, wherein said spacing change device including a lead cable rotatable around a longitudinal axis and said mounting element having a lead cable nut.

39. The adjustment device as defined in claim 29, wherein at least one spring is arranged between said support elements, said spring moving said support elements back into their initial position when tension on said tension belt is relieved.

40. The adjustment device as defined in claim 38, wherein at least one spring is arranged between said support elements, said spring moving said support elements back into their initial position when tension on said tension belt is relieved.

41. An adjustment device for beds, mattresses, seats and the like, comprising a plurality of support elements extending across an adjustment direction and spanning a support plane, and at least one drive device to pivot a plurality of said support elements relative to each other for the purpose of a slope or trend change of the support plane, said support elements being provided with at least one mounting element extending across the support plane, said mounting element being provided with a pivot joint in a first end region of said mounting element, at least one spacer device being provided to maintain the spacing of adjacent mounting elements relative to each other in the region of said pivot joint, and a plurality of spacing adjusters to change the spacing of adjacent mounting elements on the region of a second end of said mounting element that is positioned opposite the pivot joints, at least one of said mounting elements is provided with a pivot angle limiter relative to an adjacent mounting element.

42. The adjustment device as defined in claim 40, wherein at least one of said mounting elements is provided with a pivot angle limiter relative to an adjacent mounting element.

43. The adjustment device as defined in claim 41, wherein said pivot angle limiter includes a lateral stop surfaces.

44. The adjustment device as defined in claim 42, wherein said pivot angle limiter includes a lateral stop surfaces.

45. The adjustment device as defined in claim 43, wherein said pivot angle limiter is active in said second end region of mounting element.

46. The adjustment device as defined in claim 44, wherein said pivot angle limiter is active in said second end region of mounting element.

47. An adjustment device for beds, mattresses, seats and the like, comprising a plurality of support elements extending across an adjustment direction and spanning a support plane, and at least one drive device to pivot a plurality of said support elements relative to each other for the purpose of a slope or trend change of the support plane, said support elements being provided with at least one mounting element extending across the support plane, said mounting element being provided with a pivot joint in a first end region of said mounting element, at least one spacer device being provided to maintain the spacing of adjacent mounting elements relative to each other in the region of said pivot joint, and a plurality of spacing adjusters to change the spacing of adjacent mounting elements on the region of a second end of said mounting element that is positioned opposite the pivot joints, said mounting elements are designed in pairs and the pairs form a chain, and said spacing adjusters being are arranged between the pairs.

48. The adjustment device as defined in claim 46, wherein said mounting elements are designed in pairs and the pairs form a chain, and said spacing adjusters being are arranged between the pairs.

49. An adjustment device for beds, mattresses, seats and the like, comprising a plurality of support elements extending across an adjustment direction and spanning a support plane, and at least one drive device to pivot a plurality of said support elements relative to each other for the purpose of a slope or trend change of the support plane, said support elements being provided with at least one mounting element extending across the support plane, said mounting element being provided with a pivot joint in a first end region of said mounting element, at least one spacer device being provided to maintain the spacing of adjacent mounting elements relative to each other in the region of said pivot joint and a plurality of spacing adjusters to change the spacing of adjacent mounting elements on the region of a second end of said mounting element that is positioned opposite the pivot joints, said mounting elements are configured with an offset bend.

50. The adjustment device as defined in claim 48, wherein said mounting elements are configured with an offset bend.

* * * * *